US005788523A

United States Patent [19]

Burnette et al.

[11] Patent Number: 5,788,523

[45] Date of Patent: Aug. 4, 1998

[54] INTERCONNECT ASSEMBY FOR A PORTABLE COMMUNICATION DEVICE

[75] Inventors: Donald W. Burnette, Sunrise; Eduardo J. Marabotto, Miami, both of Fla.; Tyler D. Jensen, San Diego, Calif.

[73] Assignee: Motorola, Inc., Schaumburg, Ill.

[21] Appl. No.: 795,215

[22] Filed: Feb. 5, 1997

[51] Int. Cl.[6] ..... H01R 13/64

[52] U.S. Cl. ..... 439/248; 439/946

[58] Field of Search ..... 439/76.1, 247, 439/248, 357, 358, 680, 946

[56] References Cited

U.S. PATENT DOCUMENTS 4,026,625 5/1977 Koiko et al. ..... 439/405
4,781,626 11/1988 Lazarchik ..... 439/680
5,277,627 1/1994 Matsuzaki ..... 439/76.1
5,620,329 4/1997 Kidd et al. ..... 439/248

*Primary Examiner*—Neil Abrams
*Assistant Examiner*—Yong Ki Kim
*Attorney, Agent, or Firm*—Barbara R. Doutre

[57] ABSTRACT

An interconnect assembly (100) interconnects an accessory (102) to a portable radio (104). The interconnect assembly (100) allows the accessory (102) to be connected to the portable radio (104) through an alignment which is perpendicular to that of the radio assembly alignment. The connector (102) includes a header (136) having spring contacts (154) which mate with narrowly pitched stationary contacts (124) located on the bottom surface (116) of the portable radio (104). The header (136) is able to move within the connector (102) such that it can easily align and connect with the stationary contacts (124).

5 Claims, 2 Drawing Sheets

INTERCONNECT ASSEMBY FOR A PORTABLE COMMUNICATION DEVICE

TECHNICAL FIELD

This invention relates in general to interconnect assemblies and more specifically to interconnect assemblies for portable communication devices.

BACKGROUND

A common challenge in portable communication equipment is a reliable accessory interconnect. Due to the miniaturization and integration of portable products, the available area for accommodating external accessories is often reduced. Design concerns, such as alignment, life cycle, and contact pitch need to be taken into account when designing external accessory connectors. Typical accessory connectors use threaded fasteners and contact schemes having a large contact pitch. However, smaller products providing more features are now requiring an increased number of contacts forcing the pitch between contacts to be reduced. Additionally, size constraints may force connector features to be on one portion of a product's housing while alignment features are located on another portion of the product's housing creating large assembly tolerances which must be addressed.

Accordingly, there is a need for an improved interconnect assembly which can accommodate small contact pitch while providing alignment between various sections of a housing.

DETAILED DESCRIPTION OF THE PREFERRED EMBODIMENT

Figure 1:
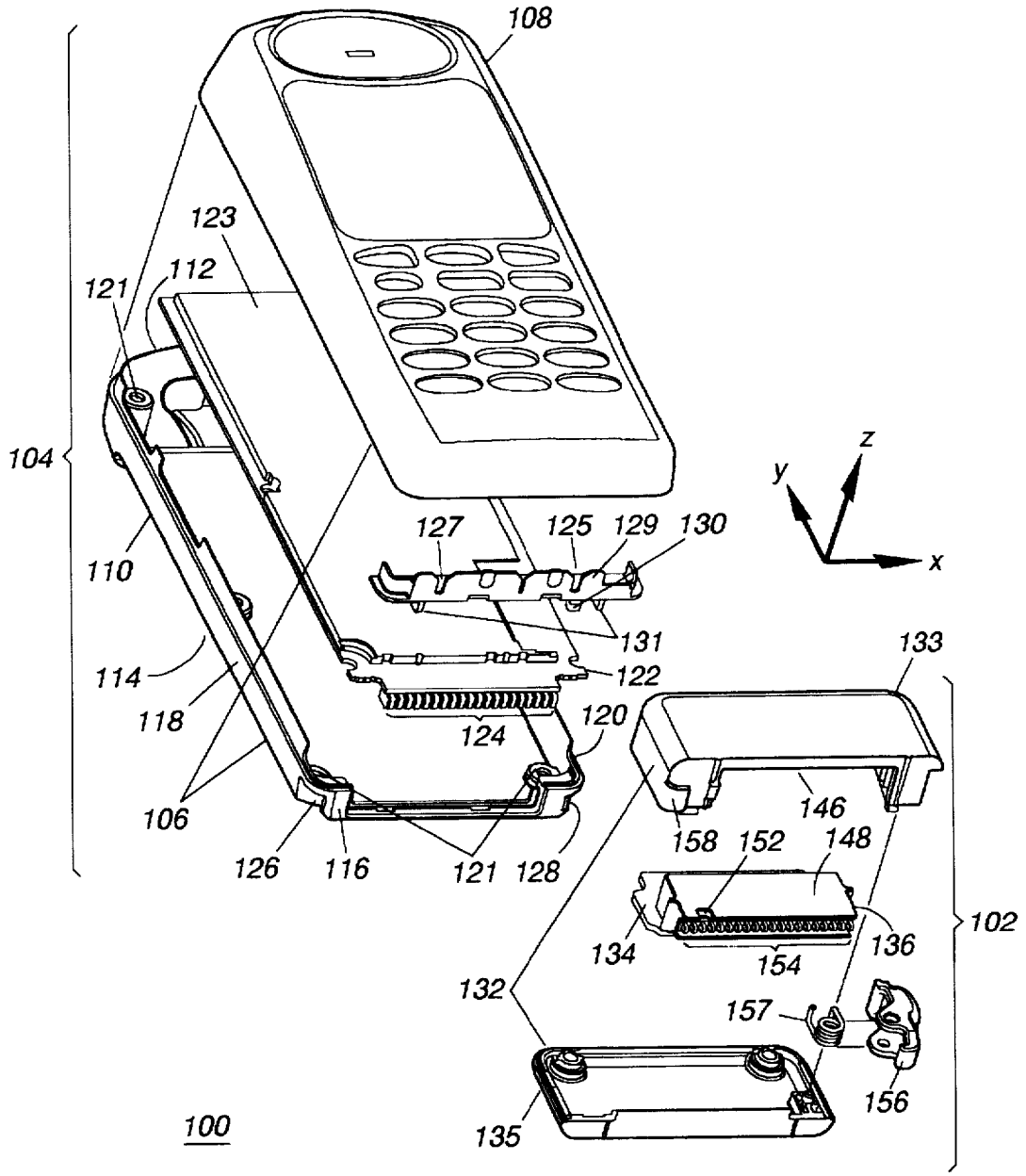
FIG. 1 is an exploded view of the interconnect assembly for a portable communication device in accordance with the present invention.

While the specification concludes with claims defining the features of the invention that are regarded as novel, it is believed that the invention will be better understood from a consideration of the following description in conjunction with the drawing figures, in which like reference numerals are carried forward.

Figure 2:
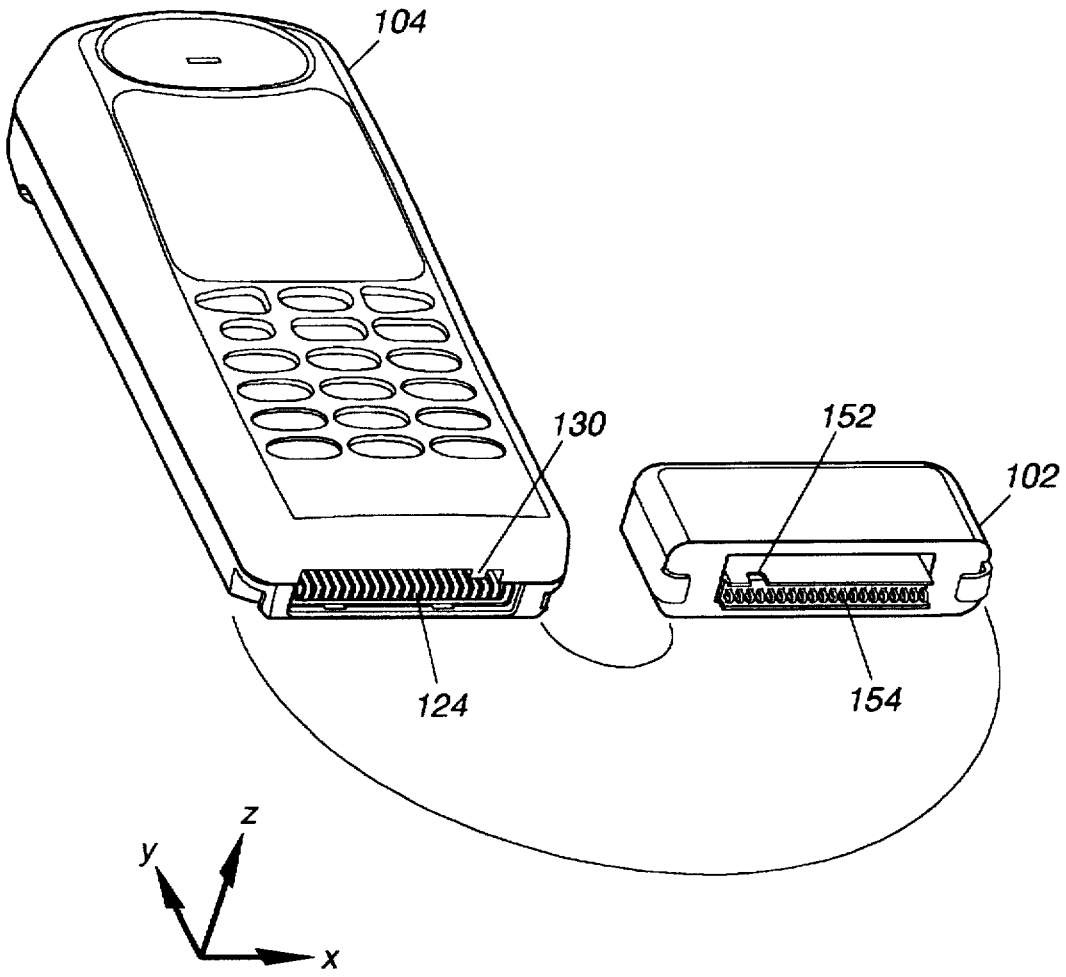
FIG. 2 a non-exploded view of FIG. 1 in accordance with the present invention.

Referring to FIG. 1, there is now an exploded view of an interconnect assembly for a portable communication device 100 in accordance with the present invention. FIG. 2 shows the non-exploded view of FIG. 1. The interconnect assembly is comprised of connector 102 for coupling to a communication device 104. The portable communication device 104, preferably a portable radio, includes a housing formed of front and back housing portions 108, 110 respectively. The back housing portion 110 includes top, back, bottom, and first and second side surfaces 112, 114, 116, 118, and 120 respectively. The back housing portion 110 is preferably coupled to the front housing portion 108 through screws (not shown) threaded through the back surface 114 of the back housing portion 110 through threaded screw holes 121. The front and back housing portions 108, 110 are preferably formed of molded plastic.

Portable communication device 104 further includes circuit board 122 which is preferably shielded through a shield 123. Coupled to the circuit board 122 are a plurality of stationary contacts 124. When portable communication device 104 is assembled, the plurality of stationary contacts 124 are exposed through an opening in the bottom surface 116 of the back housing portion 110. In accordance with the present invention, when the portable communication device 104 is assembled, the circuit board 122 and plurality of stationary contacts 124 are forwardly aligned towards the front housing portion 108. This forward alignment is pictorially indicated by the z axis of FIG. 1. A retention feature 125 is used to retain the circuit board 122 in position within the assembled housing. Retention feature 125 is preferably formed of a molded piece of plastic which includes an alignment base plate 127 and an upper retention wall 129 extending therefrom. The alignment base plate 127 includes sidewalls 131 extending from the base plate. When the portable communication device 104 is assembled, the back housing portion 110 is screwed into the front housing portion 108 thereby compressibly fitting retention feature 125 into the front housing such that the row of stationary contacts 124 are received between sidewalls 131. An alignment rib 130 is preferably included on the alignment feature 125 for later use in the alignment of the accessory connector 102. Once assembled, alignment rib 130 is found on the bottom surface 116 of the portable communication device 104. First and second notches 128, 126 respectively are located on the first and second side surfaces 118, 120 of the back housing portion 110 for receiving connector 102.

In accordance with the present invention, connector 102 now aligns with the portable communication device 104 which has a forwardly aligned set of contacts which are located on the bottom surface 116 of the portable communication device. In accordance with the present invention, the connector 102 connects onto the bottom surface 116 of the portable communication device 104 through an axial alignment which is perpendicular to that of the assembly alignment of the portable communication device. This interconnect is achieved through a floating header 136 of connector 102 in accordance with the present invention. This perpendicular alignment is depicted by the y axis in FIGS. 1 and 2.

As seen in FIG. 1, the connector 102 of the present invention is comprised of a connector housing 132, preferably formed of first and second housing portions 133, 135 respectively. The connector housing 132 is preferably formed of a material similar to that of the housing of portable communication device 104. A circuit board 134 is located within the connector housing 132. The first housing portion 133 has an opening 146 formed therein and through which the floating header 136 protrudes when assembled. Connector 102 provides the interconnect for an external accessory, such as a remote speaker.

As seen in FIG. 2 and in accordance with the present invention the floating header 136 protrudes from the opening 146 of the connector housing 132. In accordance with the present invention, floating header 136 is a non-stationary header which is assembled into the connector housing 132 such that it has a predetermined amount of travel within the connector. For the floating header 136 shown in the embodiment of FIGS. 1 and 2 the amount of travel from side to side is preferably 0.40 millimeters. The floating header 136 of the present invention is thus slidably moveable within the connector housing 132. This eases the alignment with the stationary contacts 124 of the bottom surface 116 of the back housing 110 of portable communication device 104.

The floating header 136 includes top wall 148 which preferably includes an alignment notch 152 for receiving the alignment rib 130 located on the bottom surface 116 of the back housing 110. The alignment notch 152 is preferably offset to one side as shown to prevent the header 136 from being inserted backwards into the portable communication device. A plurality of spring contacts 154, preferably accordion type spring contacts, are snap fitted into the floating header 136 such that one end of each contact protrudes from the header and another end is soldered to the circuit board 134. The protruding ends of the spring contacts 154 mate with the plurality of stationary contacts 124 located on the bottom surface 116 of the communication device.

A hook 158 is coupled to the connector housing 132 for hooking to the first notch 128 of the portable communication device 104. A latch 156 is coupled to the connector housing 132, preferably through spring 157, for latching to the second notch 126 of the portable communication device housing. In accordance with the present invention, the assembled connector 102 upwardly aligns (along the y axis) with the bottom surface 116 of the communication device 102 at an angle perpendicular to that of the portable communication device assembly alignment (z axis). This interconnect is achieved by the hook 158 hooking into the first notch 128, the alignment notch 152 (if implemented) aligning with the alignment rib 130, the latch 156 latching into the second notch 126, and the spring contacts 154 mating to the corresponding stationary contacts 124 through the floating header 136. Thus, the connector 102 having the floating header 136 described by the invention allows a radio having a forward alignment feature to be coupled to an accessory through a perpendicular upward alignment.

For the embodiment shown in FIGS. 1 and 2, a plurality of stationary contacts having a contact pitch of approximately 1.5 millimeters between contacts is implemented. Various contact pitches can be provided depending on the design needs. Providing an interconnect assembly which allows for a narrow contact pitch has the advantage of being able to accommodate more contacts.

Contact life cycle between the connector 102 and the portable communication device 104 implementing the interconnect assembly 100 described by the invention exceeds 30,000 cycles which is an improvement over prior art connectors which typically have a life cycle in the 5000 cycle range. Thus, the interconnect assembly 100 described by the invention allows for more tightly pitched contacts on radios and increased interconnect life cycles between accessories and radios.

Accordingly, there has been provided an interconnect assembly which allows an accessory to mate to a radio on an axis perpendicular to that of the radio alignment. The connector 102 described by the invention allows for smaller communication products to have an increased number of contacts with narrower pitches by providing a loading mechanism through a floating header which provides a reliable interconnect. By floating the spring contact header 136 within the connector housing 132, assembly tolerances are reduced.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An interconnect assembly for a portable communication device, comprising:

at the portable communication device:

a housing having front, back, top, bottom, and first and second side surfaces;

a circuit board located within the portable communication device;

a plurality of stationary contacts coupled to the circuit board, the plurality of stationary contacts being exposed through the bottom surface of the portable communication device, the circuit board and plurality of stationary contacts being forwardly aligned towards the front surface of the housing; and first and second notches located on the first and second side surfaces respectively;

a connector, comprising:

a connector housing;

a circuit board located within the connector housing;

a floating header coupled within the connector housing such that the floating header has a predetermined amount of travel within the connector;

a plurality of spring contacts snap fitted into the floating header and coupled to the circuit board for mating with the plurality of stationary contacts located on the bottom surface of the portable communication device;

a hook coupled to the connector housing for hooking to the first notch;

a latch coupled to the connector housing for latching to the second notch; and the connector housing upwardly aligning with the bottom surface of the portable communication device through the hook hooking into the first notch, the latch latching into the second notch, and the spring contacts mating to the corresponding mating stationary contacts through the floating header.

2. An interconnect assembly for a portable communication device as described in claim 1, wherein the portable communication device comprises a portable radio.

3. An interconnect assembly for a portable communication device as described in claim 1, further comprising:

at the portable communication device:

an alignment rib coupled to the bottom surface of the housing; and at the connector:

an alignment notch located on the floating header for receiving the alignment rib located on the bottom surface of the portable communication device.

4. An interconnect assembly for connecting an accessory to a portable radio, comprising:

at the accessory:

a connector housing having top bottom, and side surfaces, the top surface having an opening formed therein;

a header including sidewalls formed about a plurality of spring contacts, the header coupled within the opening of the connector housing such that the plurality of spring contacts are exposed above the top surface of the connector housing, the header being slidably moveable within the connector housing, and at least one of the sidewalls of the header including an alignment notch;

a hook coupled to the connector housing; and a latch coupled to the connector housing;

at the radio:

a radio housing having top, bottom, back, and side surfaces;

a plurality of stationary contacts exposed along the bottom surface of the radio housing, the radio being characterized by an axial assembly alignment;

first and second notches formed within the side, bottom, and back surfaces of the radio housing;

an alignment rib coupled to the bottom surface of the radio housing; and wherein the accessory connects with the radio using an assembly alignment which runs perpendicular to the axial assembly alignment of the radio by hooking the hook to the first notch of the radio housing, latching the latch to the second notch of the radio housing and thereby aligning the alignment notch of the header with the alignment rib of the radio housing and slidably coupling the spring contacts to the plurality of stationary contacts.

5. An interconnect assembly for a radio and an accessory as described in claim 4, wherein the plurality of spring contacts are accordion type spring contacts.

* * * * *